US011624553B2

(12) United States Patent
Bassler et al.

(10) Patent No.: US 11,624,553 B2
(45) Date of Patent: Apr. 11, 2023

(54) STORAGE PLATE ARRANGEMENT HAVING CARRIER FRAME HAVING A PROFILE RAIL THAT IS EMBODIED FROM METAL, AS WELL AS HOUSEHOLD REFRIGERATION APPLIANCE

(71) Applicant: BSH HAUSGERAETE GMBH, Munich (DE)

(72) Inventors: Daniel Bassler, Aalen (DE); Felix Haenssler, Langenau (DE); Thomas Wykydal, Sontheim (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/404,301

(22) Filed: Aug. 17, 2021

(65) Prior Publication Data

US 2022/0082321 A1 Mar. 17, 2022

(30) Foreign Application Priority Data

Sep. 15, 2020 (DE) ..... 10 2020 211 569.9

(51) Int. Cl.
*F25D 25/02* (2006.01)
*A47B 96/02* (2006.01)

(52) U.S. Cl.
CPC ..... *F25D 25/02* (2013.01); *F25D 25/024* (2013.01); *A47B 96/02* (2013.01); *F25D 2325/021* (2013.01); *F25D 2325/022* (2013.01)

(58) Field of Classification Search
CPC ..... F25D 25/02; F25D 2325/021; F25D 2325/022; F25D 25/024; A47B 96/02
See application file for complete search history.

(56) References Cited

U.S. PATENT DOCUMENTS

| | | | | |
|---|---|---|---|---|
| 5,813,741 | A | 9/1998 | Fish et al. | |
| 9,103,582 | B2 | 8/2015 | Nash et al. | |
| 9,574,820 | B2 * | 2/2017 | Lee | A47B 96/025 |
| 10,935,305 | B1 * | 3/2021 | Bassler | F25D 25/024 |
| 11,035,531 | B1 * | 6/2021 | Wanta | H01R 4/48 |
| 11,156,399 | B2 * | 10/2021 | Staud | F25D 25/02 |

(Continued)

FOREIGN PATENT DOCUMENTS

| | | | | |
|---|---|---|---|---|
| DE | 102015119599 | A1 * | 5/2017 | |
| EP | 2184570 | A1 * | 5/2010 | F25D 25/02 |

(Continued)

*Primary Examiner* — Kimberley S Wright
(74) *Attorney, Agent, or Firm* — Laurence A. Greenberg; Werner H. Stemer; Ralph E. Locher

(57) ABSTRACT

A storage plate arrangement for installation in a household refrigeration appliance has a first storage plate and a second storage plate, which is separate from the first storage plate, and a carrier frame. The first storage plate and the second storage plate are arranged on the carrier frame. The carrier frame has a guiding arrangement and a storage plate can be displaced by the guiding arrangement relative to the carrier frame and to the other storage plate. The carrier frame is embodied as open when viewed in the peripheral direction. The carrier frame has a first side limb and an opposite-lying second side limb that is separate from the first side limb and the side limbs are connected to a connecting limb that is in turn separate from the side limbs. The connecting limb is a profile rail that is embodied from metal.

14 Claims, 6 Drawing Sheets

(56) References Cited

U.S. PATENT DOCUMENTS

| | | | | |
|---|---|---|---|---|
| 11,296,433 | B1 * | 4/2022 | Wanta | A47F 3/001 |
| 2016/0238307 | A1 * | 8/2016 | Lee | F25D 25/02 |
| 2017/0234604 | A1 | 8/2017 | Eicher et al. | |

FOREIGN PATENT DOCUMENTS

| | | | | | |
|---|---|---|---|---|---|
| KR | 20140134865 | A * | 11/2014 | | |
| WO | WO-2014082858 | A1 * | 6/2014 | | F25D 25/02 |

* cited by examiner

STORAGE PLATE ARRANGEMENT HAVING CARRIER FRAME HAVING A PROFILE RAIL THAT IS EMBODIED FROM METAL, AS WELL AS HOUSEHOLD REFRIGERATION APPLIANCE

CROSS-REFERENCE TO RELATED APPLICATION

This application claims the priority, under 35 U.S.C. § 119, of German patent application DE 10 2020 211 569.9, filed Sep. 15, 2020; the prior application is herewith incorporated by reference in its entirety.

BACKGROUND OF THE INVENTION

Field of the Invention

One aspect of the invention relates to a storage plate arrangement. The storage plate arrangement is embodied in particular for installation in a household refrigeration appliance. The storage plate arrangement has a first storage plate and a second storage plate that is separate from the first storage plate. The storage plate arrangement furthermore has a carrier frame. The first storage plate and the second storage plate are arranged on this carrier frame. The carrier frame has a guiding arrangement. At least one of the storage plates is mounted by this guiding arrangement so that the storage plate can be displaced relative to the carrier frame and relative to the other storage plate. The carrier frame is embodied as open in the peripheral direction. A further aspect of the invention relates to a household refrigeration appliance having a storage plate arrangement of this type.

In the case of known embodiments of storage plate arrangements of this type, the carrier frames that are not entirely closed on the peripheral side are the components for direct arrangement, in particular on an inner container of a household refrigeration appliance. Various possibilities are known in this context for how it is possible to fasten a carrier frame of this type to the walls of the inner container. For example, the ribs are embodied on the inner container, wherein the carrier frame is pushed over these ribs. It is also possible that this carrier frame is fastened to recesses in the rear wall of a household refrigeration appliance by a mounting arrangement.

Carrier frames are known in which the individual components are embodied from plastic. In this context, the U-shape of a carrier frame of this type can be embodied as one piece from plastic. One-piece embodiments of this type from plastic are rather limited in their rigidity. Furthermore, the embodiments also optically convey a less stable impression.

Furthermore, multi-part embodiments of a carrier frame of this type are also known. In this context, exemplary embodiments are also known that have a U-shaped base frame that is entirely embodied from metal. Embodiments of this type are however relatively heavy. High material costs are associated with the metal frames. Furthermore, a high assembly outlay is required. It is also possible that additional components are screwed to a metal base frame of this type. As a consequence, the number of components increases and the assembly outlay is increased by the screwing procedure.

U.S. Pat. No. 9,103,582 B2 discloses a storage plate arrangement. This arrangement has two glass plates that are surrounded in each case by a frame. The two plates can be displaced relative to one another in the depth direction of the arrangement. The arrangement furthermore has a frame and these two plates are held by the frame. However, the frame extends with its side limbs only over the length of the rear plate. The front plate protrudes forward in an in-use position over the side limbs. In this regard, the front plate protrudes freely forward. As a consequence, this front plate is heavily loaded in the in-use position. Large lever forces act upon the mechanical connection of this front plate to the frame. Furthermore, in the case of this known embodiment of the arrangement it is provided that holding clamps are a component of this carrier frame. These holding clamps are however arranged almost entirely exposed. As a consequence, it is possible for functional impairments to arise. Furthermore, the fastening arrangement and holding arrangement is limited to the rest of the components of the carrier frame. The overall mechanical stability of the carrier frame is consequently reduced.

BRIEF SUMMARY OF THE INVENTION

The object of the present invention is to provide a storage plate arrangement in which a carrier frame of the storage plate arrangement is improved, the storage plate arrangement being not entirely closed on the peripheral side.

This object is achieved by a storage plate arrangement and a household refrigeration appliance in accordance with the independent claims.

One aspect of the invention relates to a storage plate arrangement. The storage plate arrangement is in particular embodied for installation in a household refrigeration appliance. The storage plate arrangement has a first storage plate and a second storage plate that is separate from the first storage plate. The storage plate arrangement furthermore has a carrier frame. The first storage plate and the second storage plate are arranged on this carrier frame. The carrier frame has a guiding arrangement. At least one of the storage plates is mounted by this guiding arrangement so that the storage plate can be displaced relative to the carrier frame and relative to the other storage plate. The carrier frame is embodied as open in the peripheral direction.

The carrier frame in relation to its open shape has a first side limb and an opposite-lying second side limb that is separate from the first side limb. The carrier frame has a connecting limb that is separate from the side limbs. The connecting limb is a profile rail that is embodied from metal.

A particularly stable central part, namely the connecting limb, is provided by this construction of the carrier frame. It is possible to fasten the side limb directly and in a stable manner to said connecting limb. The connecting limb supports the side limb and in this case also receives lever forces in an improved manner. The connecting limb has a high degree of torsional rigidity. As a consequence, the fastening arrangement to other components is also improved. Furthermore, the receiving arrangement of the storage plates is also improved. The reason for this is that the rigidity of these central parts also renders it possible for at least one storage plate to move in a manner in which it jams less often and the movement is smoother. In addition, this material embodiment of the connecting limb in particular also renders possible the individual embodiment of the optical appearance of the storage plate arrangement in addition to the above-mentioned advantages. In the case of an embodiment from metal in particular, it is possible in conjunction with the embodiment of a profile rail to achieve relatively thin wall thicknesses with nevertheless increased stability and rigidity. This connecting limb in particular, to which in the intended manner the freely protruding side limb is expediently fastened on the end side, renders it possible to be able to also arrange this as horizontally as possible.

In particular, the open carrier frame is embodied as three-sided. In particular, the carrier frame is embodied as U-shaped. In particular, the side limbs are embodied from plastic.

In one exemplary embodiment, the profile rail is produced as one piece. It is therefore possible to save assembly costs. Furthermore, it is possible by producing it as one piece to also produce the profile region of this central rail in a particularly precise and geometrically accurate manner. The mechanical stability is particularly advantageous not least because of this one-piece embodiment.

In one exemplary embodiment, the profile rail is a roll formed profile. In particular in the case of the embodiment from metal, a roll formed profile of this type is relatively simple to produce. Even in the case of more complex profile shapes, this roll forming process is advantageous. It is then possible by this roll forming to produce the profile part that is more complex in shape in the form of the profile rail from a for example planar plate embodied from metal, for example from a metal plate. In particular, the one-piece embodiment is therefore particularly advantageous and geometrically accurate. A roll formed profile as a profile rail therefore represents a particularly advantageous exemplary embodiment.

In one exemplary embodiment, the profile rail is embodied from stainless steel. This exemplary embodiment is particularly advantageous for the use of the storage plate arrangement in the most varied of surrounding conditions such as can be the case in a household refrigeration appliance. Since here where applicable it is also possible for large temperature differences and/or moisture differences to occur, in the case of an embodiment of this type from stainless steel for example a high degree of resistance to corrosion is also achieved.

In one exemplary embodiment, this profile rail is embodied as straight. This means that said profile rail has a longitudinal axis that is straight.

In particular, the connecting limb is embodied as a profiled bar or profiled board. This means that the connecting limb has a length that is greater, in particular many times greater, than the height and the depth.

It is possible by the embodiment of the connecting limb as a profile rail to also produce individual profile shapes. This is with regard to the increase of the stability of the rail itself as well as with regard to the improved fastening arrangement of the side limb.

In this exemplary embodiment, it is thus possible that the profile rail has a first upper hollow chamber. The upper hollow chamber is to be understood in this regard with a view to the height direction of the storage plate arrangement. This first upper hollow chamber is formed on an upper edge of a front plate of the profile rail, in particular by a roll forming process. This front plate is consequently also a component of the profile rail. When viewed in the depth direction of the storage plate arrangement, this front plate is consequently arranged in front of the hollow chamber. A front visible component of the connecting limb is consequently almost formed by the front plate. This first upper hollow chamber is formed behind said front visible component. In particular, a front side of the front plate is embodied as planar. It is therefore possible to achieve a particularly simple and nevertheless positionally-precise fastening arrangement of a side limb.

In one exemplary embodiment, the profile rail has a second lower hollow chamber that is embodied as different to and spaced from the first upper hollow chamber. This second lower hollow chamber is in particular formed on a lower edge of the front plate of the profile rail, in particular by a roll forming process. The two hollow chambers extend toward the rear starting from the front plate in the depth direction of the storage plate arrangement. In particular, an upper delimiting wall of the first upper hollow chamber is arranged flush with the upper edge of the front plate. In particular, a lower delimiting wall of the second lower hollow chamber is arranged flush with the lower edge of the front plate.

In one exemplary embodiment, the two hollow chambers are arranged entirely behind the front plate. This means that when viewed in the height direction, the chambers do not protrude upward and downward beyond the front plate. A compactly constructed profile rail is therefore achieved.

In one exemplary embodiment, in particular the two hollow chambers extend without interruption over the entire length of the front plate. The advantages in relation to the stabilization on the one hand and the coupling possibility to where applicable other components of the storage plate arrangement are consequently improved.

In one exemplary embodiment, at least one of the hollow chambers is embodied in the cross-section perpendicular with respect to a longitudinal axis of the profile rail as delimited on multiple sides, in particular as delimited on at least three sides, in particular as delimited on four sides. In one exemplary embodiment, at least one hollow chamber is embodied as open in a cross section of this type. In particular, this cross-sectional geometry of a hollow chamber is consequently formed with four sides, this cross-sectional contour is however not entirely closed in the peripheral direction. On the one hand a high degree of stability is thereby achieved, on the other hand a specific deformation elasticity of the cross-sectional geometry of the hollow chamber is rendered possible. In particular then the freely protruding limb, which forms one side of this four-sided geometry, can then also spring to a specific extent. It is thereby also possible to achieve improved fastening arrangements of the storage plate arrangement on a household refrigeration appliance component. Production tolerances can then be compensated in an improved manner by this embodiment.

In particular, the two hollow chambers are embodied accordingly in this regard.

In one exemplary embodiment, when viewed in the depth direction of the storage plate arrangement the first upper hollow chamber is embodied with a smaller depth than the lower hollow chamber. On the one hand, the rigidity of the profile rail is particularly advantageously increased by the in this regard deeper lower second hollow chamber. The hollow chambers can however also have the same depth.

In one exemplary embodiment, when viewed in the direction of its longitudinal axis the profile rail has on its first end an open embodiment. This open end is embodied as an insertion holding arrangement for an additional holding part of the storage plate arrangement. In addition to or in lieu of the insertion holding part, the profile rail is embodied on a second end as open when viewed in the direction of this longitudinal axis. This open end is embodied in one exemplary embodiment as an insertion holding arrangement for an additional holding part of the storage plate arrangement. In the intended manner, these open ends are consequently formed as coupling sites for these holding parts. This is a further particularly advantageous exemplary embodiment. The reason for this is that it is consequently possible to construct a storage plate arrangement from multiple separate components. A modular concept of this type is particularly advantageous for the formation of variants of a storage plate arrangement. It is thereby possible for example to provide a central component in the form of a profile rail for various variants as an identical component. The holding parts can then be embodied individually. This can be dependent upon where the storage plate arrangement is to be accommodated or is to be fastened. Furthermore, it is also rendered possible in a simpler manner by an embodiment of this type to exchange or to replace the respective individual parts of a storage plate arrangement of this type. In particular, it is possible for variants of the storage plate arrangement to also be formed by identical holding parts however for example various lengths of connecting limbs.

It is likewise also possible to consequently use various side limbs. This is in relation to the length of these side limbs and/or in relation to the guiding arrangement and holding arrangement of the storage plates.

This embodiment is also particularly advantageous to the extent that it is possible to make material differences between the profile rail and the holding parts. The holding parts can be embodied as one-piece components. The holding parts can be embodied for example from plastic. In particular, the holding parts can be for example injection molded components.

A holding part can be arranged on a rear end of a side limb. The holding part can be embodied as one piece with the side limb.

The open ends of the connecting limb can be embodied in their function as insertion holding arrangements for the insertion of the holding parts. The open ends can however also be provided for example so as to snap in holding parts of this type.

In one exemplary embodiment, these insertion holding arrangements are formed on the ends of the profile rail by the hollow chambers that are open to the side. These hollow chambers are thereby multifunctional. Further dedicated elements are consequently not required that would render this holding arrangement possible.

In one exemplary embodiment, a holding part comprises two engagement pins. These engagement pins are in particular embodied for inserting into the hollow chambers of the profile rail with a positive fit, in particular with a non-positive fit. In particular, the engagement pins are embodied as hollow.

A further aspect of the invention relates to a household appliance component. In particular, this is a household refrigeration appliance component. In particular, a household refrigeration appliance component of this type is a door for a household refrigeration appliance. This household refrigeration appliance component has a storage plate arrangement in accordance with the above-mentioned aspect or an advantageous embodiment thereof.

In particular, it is rendered possible to improve this storage plate arrangement by the embodiment of only the connecting limb of the carrier frame as a roll formed metal profile for example from stainless steel, aluminum or steel. The modularity with this side limb, which is in particular embodied from plastic and has the holding parts, also additionally supports this flexible system.

The specifications "upper" "lower", "in front of", "toward the rear of", "horizontal", "vertical", "depth direction", "width direction", "height direction" indicate the positions and orientations that are provided in the case of the intended use and intended positioning of the storage plate arrangement or of the household refrigeration appliance.

Further features of the invention are apparent in the claims, the figures and the description of the figures. The features and feature combinations that are mentioned above in the description, as well as the features and/or feature combinations that are mentioned below in the description of the figures and/or that are illustrated in the figures alone can be used not just in the in each case disclosed combination but rather also in other combinations or in isolation without departing the scope of the invention. Embodiments of the invention that are not explicitly illustrated and explained in the figures but are provided and can be produced by separate feature combinations of the explained embodiments are consequently to be regarded as included and disclosed. Statements and feature combinations that consequently do not have all the features of an originally worded independent claim are to be regarded as disclosed.

Other features which are considered as characteristic for the invention are set forth in the appended claims.

Although the invention is illustrated and described herein as embodied in a storage plate arrangement having carrier frame having a profile rail that is embodied from metal, as well as household refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
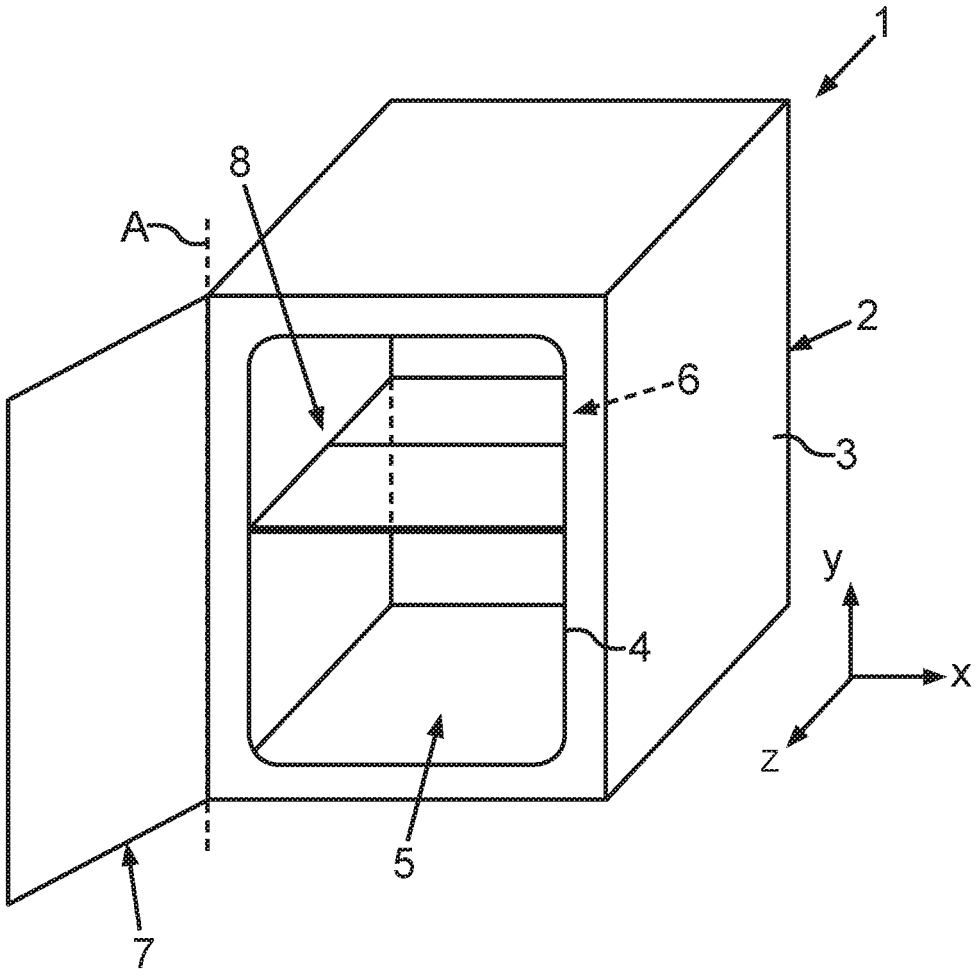
FIG. 1 is a diagrammatic, perspective view of an exemplary embodiment of a household refrigeration appliance in accordance with the invention with a schematic illustration of an exemplary embodiment of a storage plate arrangement in accordance with the invention.

Identical or functionally identical elements in the figures are provided with the same reference characters.

Referring now to the figures of the drawings in detail and first, particularly to FIG. 1 thereof, there is shown a household refrigeration appliance 1 in a simplified view. The household refrigeration appliance 1 is embodied for the purpose of storing and conserving foodstuffs. The household refrigeration appliance 1 can be for example a refrigerator or a freezer or a refrigerator-freezer combination appliance. The household refrigeration appliance 1 has a housing 2. The housing 2 has an outer housing 3 in one embodiment. The housing 2 furthermore has an inner container 4. The inner container 4 is received in the outer housing 3. The inner container 4 is separate from the outer housing 3.

The household refrigeration appliance 1 in one exemplary embodiment has at least one receiving space 5 for foodstuffs. It is also possible to provide multiple separate receiving spaces. The receiving space 5 in one exemplary embodiment can be a refrigeration compartment. The receiving space 5 is delimited by walls of the inner container 4.

In one exemplary embodiment, a thermally insulating material is arranged in an intermediate space 6 between the outer housing 3 and the inner container 4.

The household refrigeration appliance 1 in one exemplary embodiment has a door 7. The door 7 in one exemplary embodiment is arranged in a movable manner on the housing 2. In one exemplary embodiment, the door 7 can pivot about an axis A that is oriented in a height direction (y-direction). The receiving space 5 can be closed on the front side using the door 7.

FIG. 1 furthermore illustrates in a schematic view an exemplary embodiment of a storage plate arrangement 8. The storage plate arrangement 8 is illustrated in its end position in the receiving space 5. The storage plate arrangement 8 can be removed from the receiving space 5 in a detachable manner without being destroyed. As is apparent, the storage plate arrangement 8 extends over the entire width of the receiving space 5. This width is measured in the width direction (x-direction) of the household refrigeration appliance 1.

In one exemplary embodiment, it is provided that the storage plate arrangement 8 extends over at least 50 percent of the depth of the receiving space 5. The depth is measured in the depth direction (z-direction) of the household refrigeration appliance 1. In one embodiment, the storage plate arrangement 8 extends over at least 60 percent, in particular at least 70 percent, in particular at least 80 percent, in particular at least 90 percent of this depth of the receiving space 5.

It is possible in one embodiment to provide that the storage plate arrangement 8 can be arranged at different discrete height positions in the receiving space 5.

The storage plate arrangement 8 can be used as a compartment divider or compartment base. The storage plate arrangement 8 is also used in one exemplary embodiment so as to deposit stored goods. Stored goods of this type are foodstuffs such as drinks or food.

Figure 2:
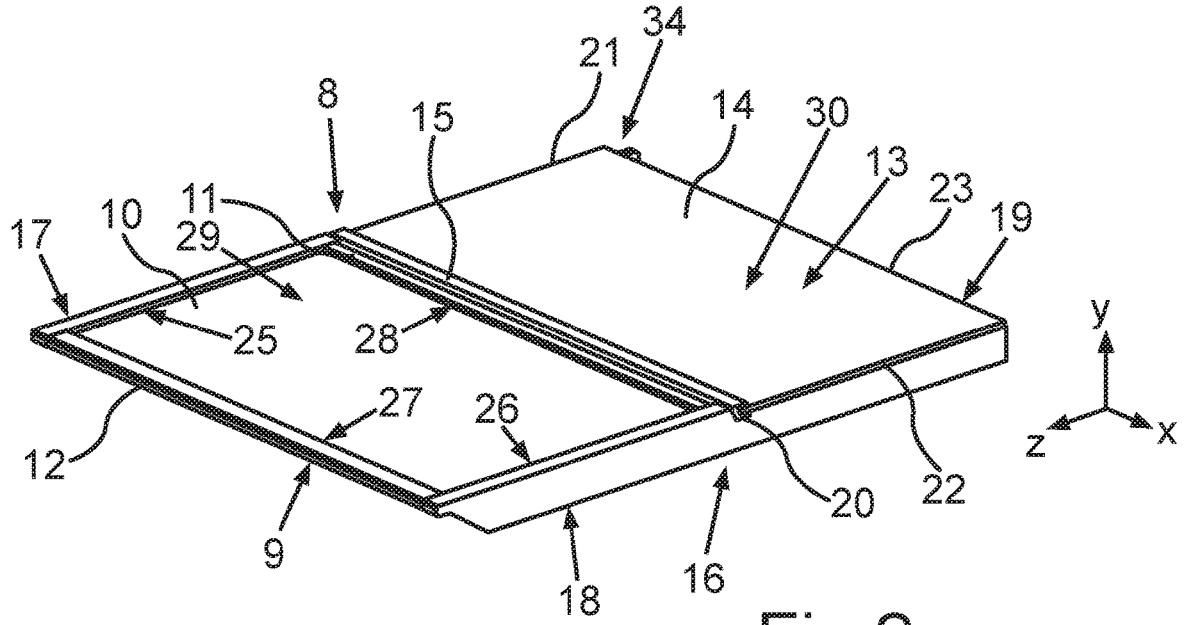
FIG. 2 is a perspective view of an exemplary embodiment of the storage plate arrangement in an in-use position of two storage plates of the storage plate arrangement.

FIG. 2 illustrates in a perspective view an exemplary embodiment of a storage plate arrangement 8. The storage plate arrangement 8 has a first storage plate 9. The first storage plate 9 has a base plate 10. The base plate 10 can be embodied for example from glass. However, the base plate can also be embodied from for example plastic. The base plate 10 is four-sided in the exemplary embodiment. In particular, the base plate is rectangular. The first storage plate 9 in the exemplary embodiment has a rear edge profile 11. The designation in relation to the rear edge profile 11 relates to the position on the first storage plate 9 with respect to other components of the first storage plate 9 when viewed in the depth direction. The rear edge profile 11 is a straight strip. The rear edge profile is in particular C-shaped or U-shaped in cross section. The edge profile 11 is embodied in one exemplary embodiment without interruption. In one exemplary embodiment, the rear edge profile 11 extends over the entire width of the base plate 10. This width is measured in the width direction. The rear edge profile 11 is a separate component to the base plate 10 in one exemplary embodiment.

In one exemplary embodiment, the first storage plate 10 has a front edge profile 12. The front edge profile 12 is embodied as a straight strip. It can be U-shaped or C-shaped in cross section. The front edge profile 12 is embodied in one exemplary embodiment, similarly to the rear edge profile 11, as in each case a separate component to the base plate 10. In one exemplary embodiment, the rear edge profile 10 can be pushed on to the base plate 10. In one exemplary embodiment, the front edge profile 12 can be pushed onto the base plate 10. In one exemplary embodiment, the rear edge profile 11 can be embodied as one piece from plastic. However, it is also possible for example for the rear edge profile to be embodied from metal. The front edge profile 12 can be embodied in one exemplary embodiment as one piece from plastic. It can also be embodied from metal.

In one exemplary embodiment, the storage plate arrangement 8 has a second storage plate 13. The second storage plate 13 is embodied in one exemplary embodiment as separate from the first storage plate 9. The second storage plate 13 in one exemplary embodiment has a base plate 14. The base plate 14 is for example embodied from glass. The base plate can however also be embodied from plastic. In one exemplary embodiment, similar to the base plate 10 the base plate 14 can also be embodied at least in regions as transparent.

In one exemplary embodiment, the second storage plate 13 has a front edge profile 15. In one exemplary embodiment, the front edge profile 15 is separate from the base plate 14. The front edge profile 15 extends in one embodiment over the entire width of the base plate 14. The front edge profile 15 can be embodied as C-shaped or U-shaped in the cross section. In one exemplary embodiment, the front edge profile 15 is arranged on a front edge of the base plate 14. The front edge profile can be pushed onto the front edge of the base plate.

The storage plate arrangement 8 in one exemplary embodiment has a carrier frame 16. The carrier frame 16 is separate from the first storage plate 9 and separate from the second storage plate 13. The carrier frame 16 is embodied in the peripheral direction and consequently embodied as open along its longitudinal extent. The peripheral direction is in the plane of the storage plate arrangement 8. In one exemplary embodiment, the carrier frame is only embodied as three-sided, in particular U-shaped. The carrier frame in one exemplary embodiment has a first side limb 17. The carrier frame furthermore has a second side limb 18 that is separate from the first side limb. The two side limbs 17 and 18 extend in the depth direction. The two side limbs 17 and 18 are arranged parallel and spaced with respect to one another. The two side limbs are straight and rod-shaped.

Furthermore, the carrier frame 16 has a connecting limb 19. This connects the two side limbs 17 and 18. The connecting limb 19 forms a central part of the carrier frame 16.

In one exemplary embodiment, the second storage plate 13 is the rear storage plate in the depth direction. In one exemplary embodiment, the second storage plate 13 is fastened in an immovable manner to the carrier frame 16. The second storage plate can be bonded in one exemplary embodiment for example to the carrier frame 16. In the illustrated exemplary embodiment, only one front edge 20 of the base plate 14 is provided with a front edge profile 15 of this type. Side edges 21 and 22 of the base plate 14 in the illustrated exemplary embodiment are not provided with further separate edge profiles of this type. Furthermore, a rear edge 23 of the base plate 14 in the illustrated exemplary embodiment is not provided with an edge profile of this type.

In one exemplary embodiment, it is provided that the base plate 14 and consequently the second storage plate 13 has a width that precisely corresponds to the distance between the two side limbs 17 and 18. As a consequence, when viewed in the width direction a lateral protrusion of the second storage plate 13 over these side limbs 17 and 18 is avoided. In particular, the side edges 21 and 22 are arranged flush with the outer sides of the side limbs 17 and 18.

Figure 3:
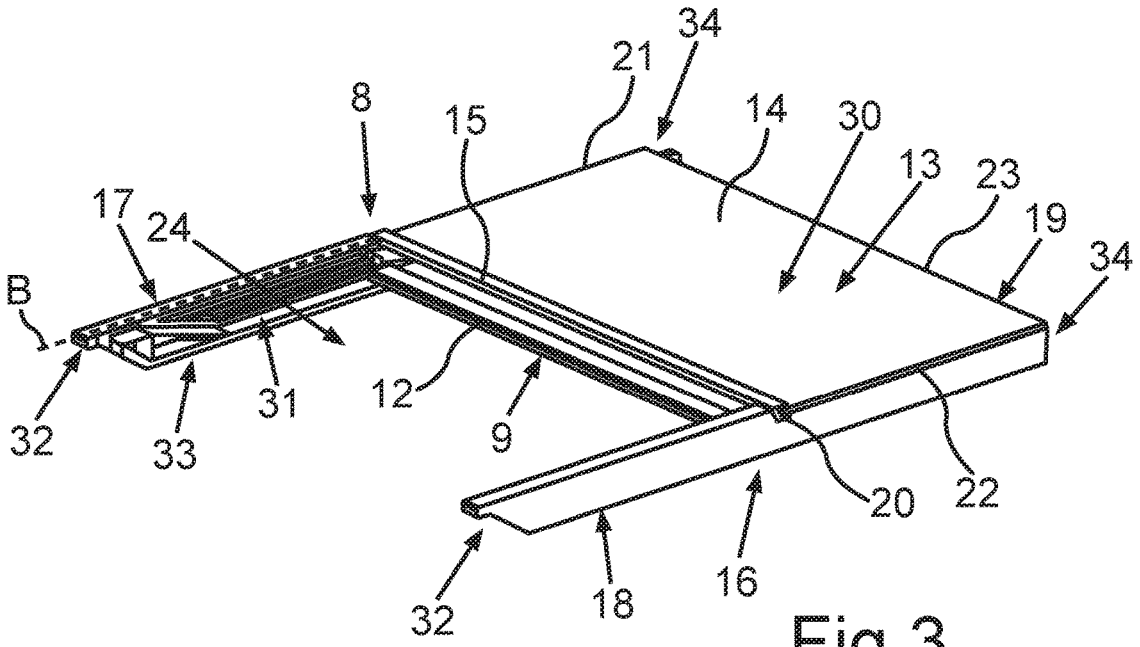
FIG. 3 is a perspective view of the storage plate arrangement in accordance with FIG. 2 in a horizontal stowed position of one of the two storage plates.

FIG. 2 illustrates an in-use position of the storage plates 9 and 13. This means that the two storage plates 9 and 13 are arranged in the depth direction one behind the other and in a row with respect to one another. As a consequence, a maximum overall storage surface of the storage plate arrangement 8 is formed. The first storage plate 9 is arranged in one exemplary embodiment as movable with respect to the second storage plate 13. The first storage plate can be displaced relative to the second storage plate 13 on the carrier frame 16 in the state in which the first storage plate is arranged on the carrier frame 16. In one exemplary embodiment, it is possible for the first storage plate for this purpose to be displaced rearward and under the second storage plate 14 starting from the in-use position that is illustrated in FIG. 2. This is illustrated in FIG. 3. In FIG. 3, a not-in-use position of the first storage plate 9 is consequently illustrated. It can be provided that when viewed in the depth direction the first storage plate 9 can be positioned entirely below the second storage plate 13. A free space is thereby formed between the side limbs 17 and 18 in the not-in-use position of the storage plate that is illustrated in FIG. 3. As a consequence, it is possible to position stored goods in the receiving space 5 below the storage plate arrangement 8 and the stored goods nevertheless extend in the height direction into this free space 24 as is illustrated in FIG. 3. It is thereby also possible to position stored goods in such a manner that they can extend upward almost through the storage plate arrangement 8.

In the exemplary embodiment in accordance with FIG. 2 and FIG. 3, it is provided that side edges 25 and 26 of the base plate 10 of the first storage plate 9 are embodied without a frame that is arranged immovably thereon. Edge profiles are consequently in particular not arranged on these side edges 25 and 26. In the illustrated exemplary embodiment, only the front edge 27 is consequently provided with the front edge profile 12 and a rear edge 28 is provided in the rear edge profile 11.

Furthermore, it is apparent that in one exemplary embodiment the first storage plate 9 is narrower in the width direction than the second storage plate 13. An upper side 29 of the first storage plate 9 in one exemplary embodiment is arranged flush with an upper side 30 of the second storage plate 13 if the in-use position of the storage plates 9 and 13, which is illustrated in FIG. 2, is set.

FIG. 3 illustrates one exemplary embodiment in which a guiding arrangement 31 is also illustrated. The guiding arrangement 31 is arranged in one exemplary embodiment on the first side limb 17 as well as on the second side limb 18. The guiding arrangement 31 has a first guiding part for this purpose. This is arranged on the first side limb 17. A second guiding part of the guiding arrangement 31 is arranged on the second side limb 18. It is possible by way of the guiding arrangement 31 for the first storage plate 9 that is movably mounted to be guided in a defined manner. The first storage plate can be displaced in this context in the depth direction.

Furthermore, the front ends 32 of the side limbs 17 and 18 are apparent. The rear ends 34 of the side limbs are also apparent. The guiding arrangement 31 is embodied on in each case an inner side 33 of a side limb 17, 18.

Figure 4:
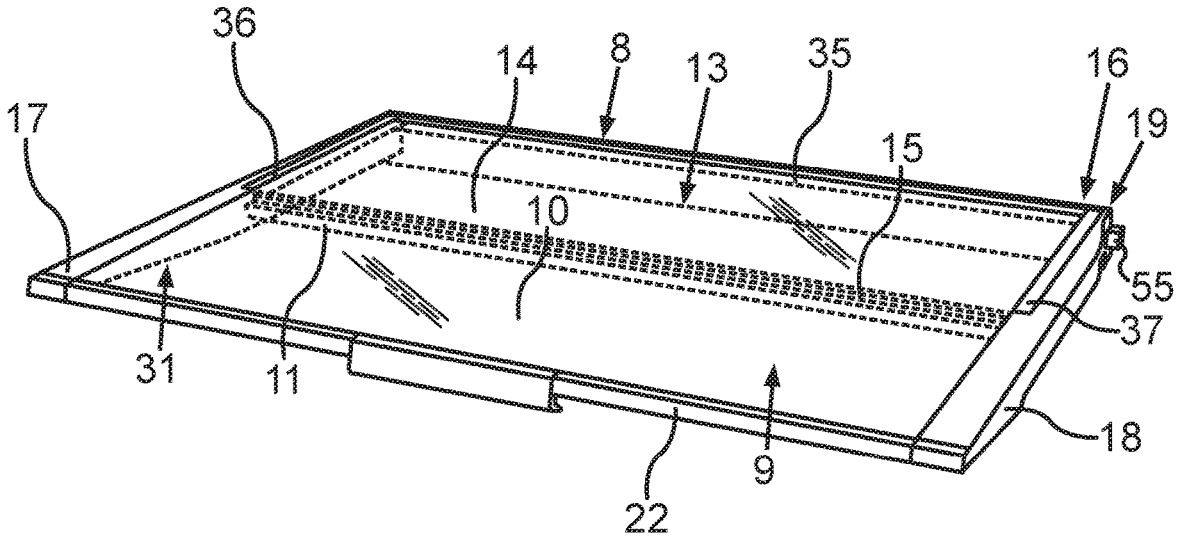
FIG. 4 is a perspective view of a further exemplary embodiment of the storage plate arrangement in an in-use position of two storage plates of the storage plate arrangement.

FIG. 4 illustrates in a perspective view a further exemplary embodiment of a storage plate arrangement 8. The difference with respect to the exemplary embodiment in accordance with FIG. 2 and FIG. 3 is provided in this case that the rear second storage plate 13 is not arranged in an immovable manner but rather is itself likewise movable. It is possible in this exemplary embodiment that the first storage plate 9 is not embodied with an entirely peripherally-closed edge profile. It is possible, as in FIG. 2 and FIG. 3, for said first storage plate 9 to have a front edge profile 12 and a rear edge profile 11.

The rear second storage plate 13 can have a front edge profile 15. In this exemplary embodiment, it can also additionally have a rear edge profile 35. It is likewise possible in addition to or in lieu of said front and rear edge profiles for said second storage plate to also have side edge profiles 36 and 37. In this exemplary embodiment, the rear storage plate 13 can thereby be embodied with an entirely peripheral edge profile apparatus.

In the case of the exemplary embodiment in FIG. 4, the front storage plate 9 is mounted so as to be displaceable in the depth direction. The guiding arrangement 31 is also provided in this regard for this purpose.

Apart from that, in particular the front first storage plate 9 can be embodied corresponding to the storage plate 9 in FIG. 2 and FIG. 3.

Figure 5:
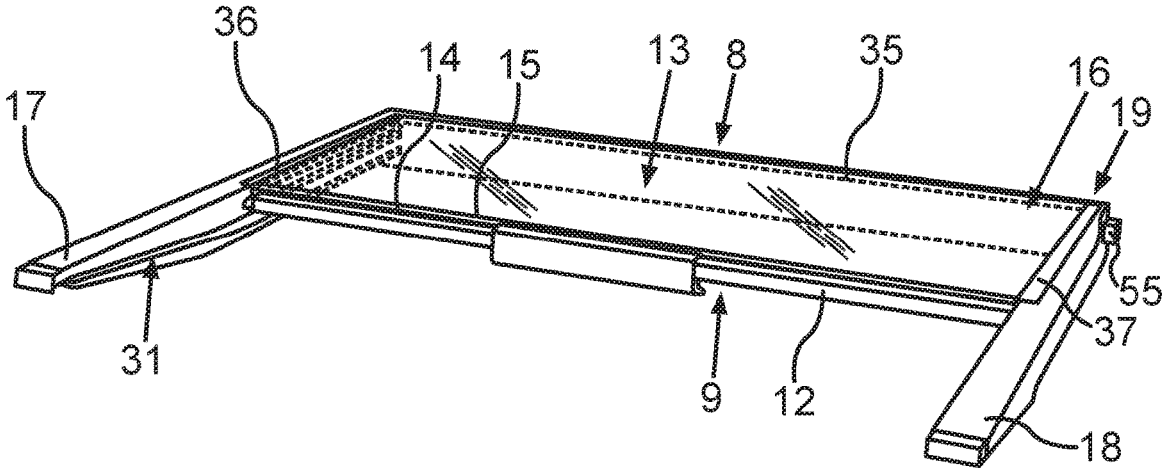
FIG. 5 is a perspective view of the storage plate arrangement in accordance with FIG. 4 in a horizontal stowed position of one of the two storage plates.

FIG. 5 illustrates the storage plate arrangement 8 in accordance with FIG. 4, wherein in this case the first front storage plate 9 is displaced from the slid-forward in-use position that is illustrated in FIG. 4 into the slid-rearward not-in-use position. In this case, the first front storage plate is then displaced below the second storage plate 13. The first front storage plate is then arranged below this storage plate 13.

Figure 6:
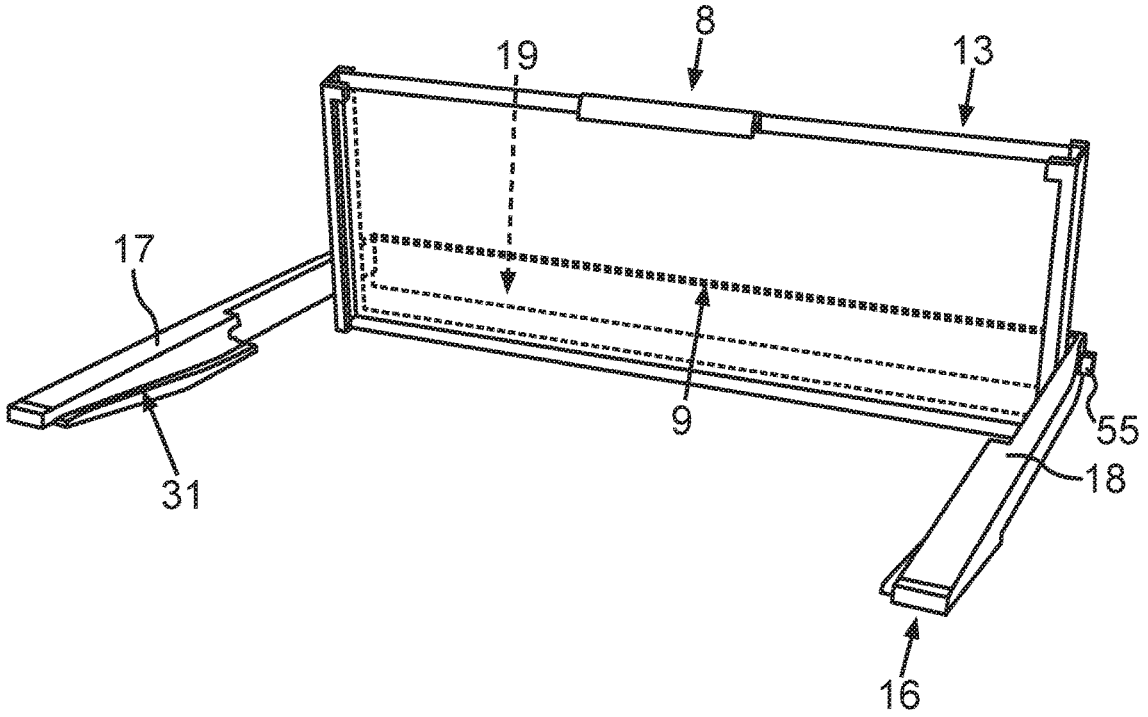
FIG. 6 is a perspective view in accordance with FIGS. 4 and 5 in a folded-up position of the plates.

In the case of this exemplary embodiment of the storage plate arrangement 8 in accordance with FIG. 4 and FIG. 5, it is possible for the storage plate stack, having the storage plates 9 and 13, to be pivoted upward about a pivoting axis that is oriented in the width direction. This is illustrated in FIG. 6. A pivoting of this type is rendered possible starting from the position that is reached in FIG. 5 of the two storage plates 9 and 13 toward one another. Additional free space is again provided by pivoting the storage plate stack upward as is illustrated in FIG. 6. Larger stored goods that are arranged in the receiving space 5 below the storage plate arrangement 8 can thereby protrude upward not merely through the free space 24, as is achieved by sliding the first storage plate 9 backward in accordance with FIG. 5, but rather also protrude upward in the region of the second storage plate 13 in this regard in particular with respect to the carrier frame 16.

Figure 7:
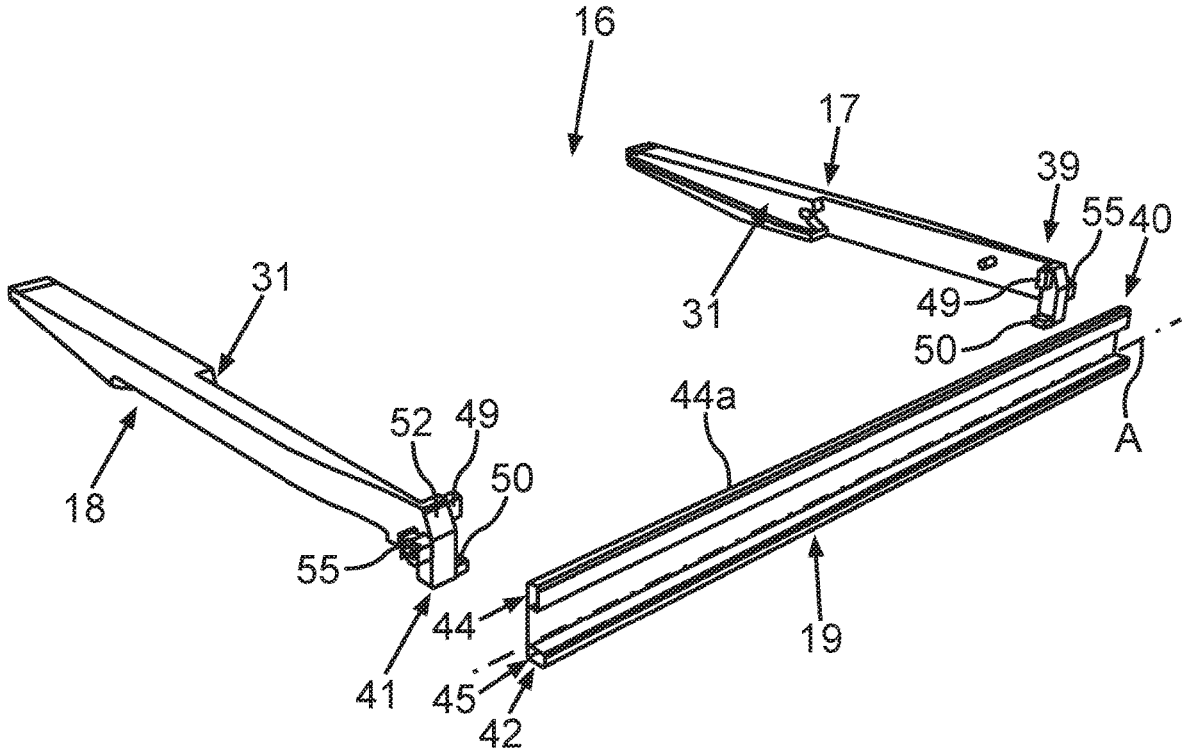
FIG. 7 is an exploded, perspective view of an exemplary embodiment of a carrier frame of an exemplary embodiment of the storage plate arrangement.

FIG. 7 illustrates an exemplary embodiment of the carrier frame 16 in an exploded view. Three separate individual parts are illustrated here. This relates to the longitudinal straight side limb 17, the longitudinal straight side limb 18 and the longitudinal straight connecting limb 19. In the exemplary embodiment, the two side limbs 17 and 18 are embodied from plastic. The two side limbs are in particular embodied in each case as one piece. A multipart embodiment is however also possible. The individual parts can be embodied in this regard from plastic. The connecting limb 19 is embodied in the illustrated exemplary embodiment as one piece from metal.

The mechanical connection between these three individual parts of the carrier frame 16 is rendered possible without an additional further fastening element. A screw connection is consequently not provided. In particular, in this regard only plug connections and/or clamping connections are provided.

This carrier frame 16, as is explained in further detail below, is provided in the case of exemplary embodiments of the storage plate arrangement 8.

This connecting limb 19 is a profile rail 38. The profile rail 38 has a longitudinal axis A. The profile rail 38 is embodied as straight. The profile rail 38 is produced as one piece. The profile rail is a roll formed profile in the exemplary embodiment. The roll formed profile is consequently in particular entirely bent into shape by a roll forming process from a plate strip. It is preferred that the profile rail 38 is embodied from stainless steel.

Furthermore, the carrier frame 16 has a first holding part 39. The first holding part 39 is arranged in the assembled state of the carrier frame 16 on a first end 40 of the profile rail 38 when viewed in the direction of the longitudinal axis A. The carrier frame 16 furthermore has a second holding part 41. The second holding part 41 is arranged in the assembled state of the carrier frame 16 on a second end 42 that lies opposite the first end 40 on the profile rail 38 that is separate therefrom. In the exemplary embodiment, the holding parts 39 and 41 are in each case one-piece components. The holding parts are in particular embodied from plastic. The holding parts are directly connected to the profile rail 38. In this assembled end state, the carrier frame 16 has a U-shape.

Figure 8:
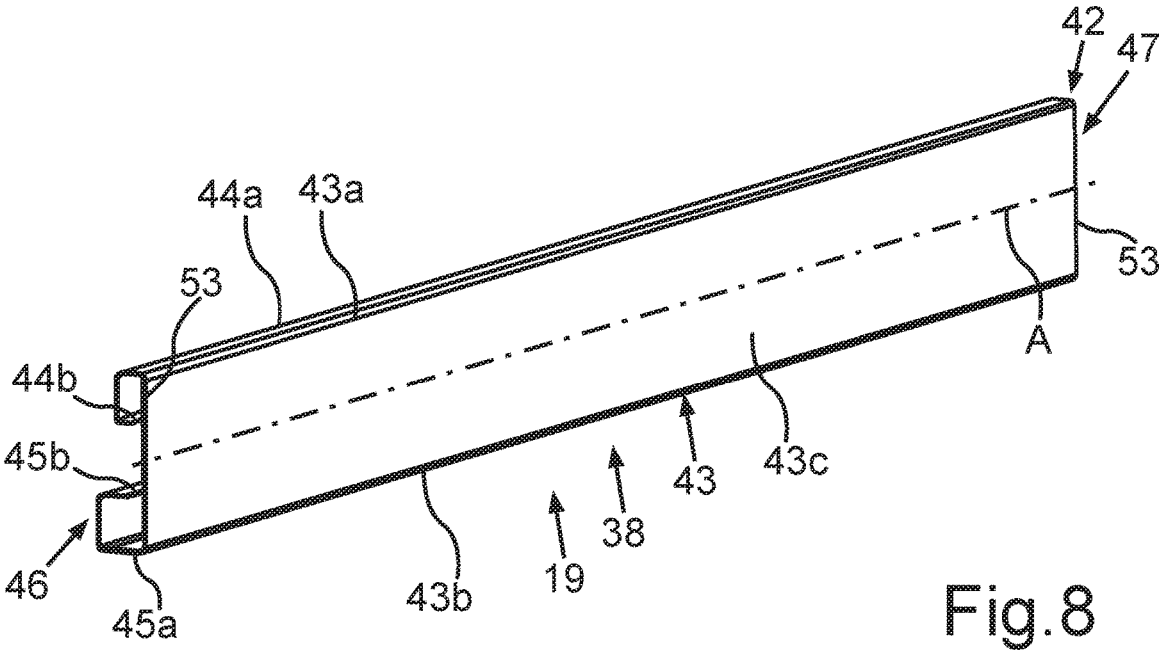
FIG. 8 is a perspective view of a profile rail of the carrier frame in accordance with FIG. 7.

FIG. 8 illustrates the profile rail 38 in a different perspective to FIG. 7. The profile rail is illustrated from the forward direction in FIG. 8. In this case, it is also apparent that the profile rail 38 is a three-dimensional formed component.

The profile rail 38 has a front plate 43. The front plate 43 is embodied without interruption. A first profile region is embodied molded on this front plate 43 as one piece. When viewed in the depth direction (z-direction) this profile region connects directly to the thin front plate 43 to the rear. This profile region is a hollow chamber 44. This is a first upper hollow chamber 44 when viewed in the height direction (y-direction).

Furthermore, the profile rail 38 has a second profile region that is different to the first profile region. This profile region in the exemplary embodiment is a second lower hollow chamber 45. The hollow chambers 44 and 45 in each case have delimiting walls that in each case delimit the hollow space.

A profile rail 38 is a component that has at least one open hollow region that is delimited by walls.

As is apparent in FIG. 8, the two hollow chambers 44 and 45 are arranged entirely behind the front plate 43. This means that the hollow chambers do not protrude upward or downward over the extent of the front plate 43. When viewed in the width direction, (x-direction), the hollow chambers 44 and 45 extend without interruption over the entire length of the front plate 43. As is also apparent in FIG. 8, an upper delimiting wall 44*a* of the first upper hollow chamber 44 is oriented horizontally. The delimiting wall directly connects to an upper boundary edge 43*a* of the front plate 43.

Furthermore, the lower hollow chamber 45 has a lower delimiting wall 45*a*. This lower delimiting wall terminates on the front side with a lower delimiting edge 43*b* (FIG. 1) of the front plate 43 or ends directly thereon.

As is also apparent in FIG. 8, the holding parts 39 and 41 are inserted into the profile rail 38. A positioning, in which the holding parts 39 and 41 are inserted into one another, is consequently provided on the profile rail 38.

Figure 9:
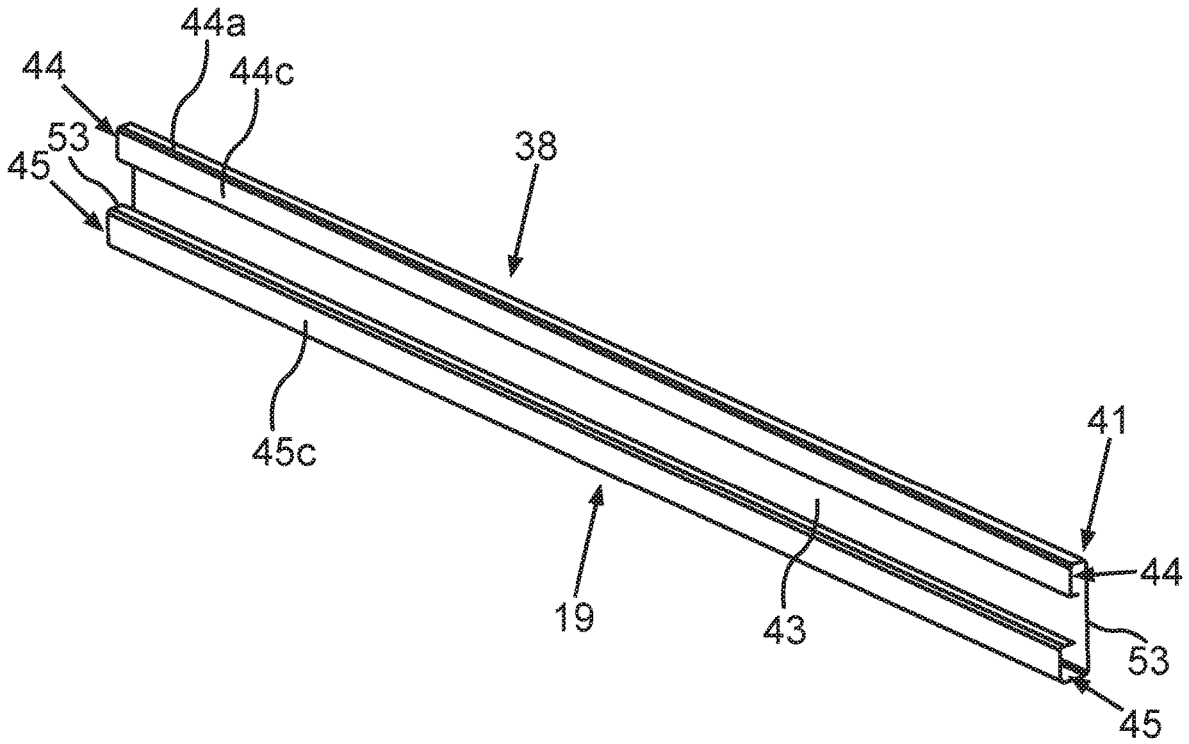
FIG. 9 is a perspective view of the profile rail in accordance with FIG. 8 in a different perspective to FIG. 8.

FIG. 9 illustrates the profile rail 38 in a further perspective view. The hollow chambers 44 and 45 are apparent. As is also illustrated in FIG. 9, the hollow chambers 44 and 45 in the exemplary embodiment are formed perpendicular in the cross section when viewed in the longitudinal axis A with a four-sided cross-sectional shape. Furthermore, it is also apparent that this cross-sectional shape is not entirely closed. In particular, in the case of the upper hollow chamber 44 a lower delimiting wall 44*b* is thus embodied as open or not directly connecting to the front plate 43. Furthermore, an upper delimiting wall 45*b* of the lower hollow chamber 45 is arranged spaced with respect to the front plate 43. The lower hollow chamber 45 is thereby also not entirely closed in the peripheral direction when viewed in the cross section.

Furthermore, it is apparent in FIG. 8 and FIG. 9 in the exemplary embodiment that the upper hollow chamber 44 has a smaller depth than the lower hollow chamber 45 in the depth direction (z-direction).

Furthermore, it is also provided that the profile rail 38 is embodied both as open on the first end 40 as well as on the second end 42. n particular, in this regard the hollow chambers 44 and 45 are embodied as open on these opposite-lying ends 40 and 42. A first insertion holding arrangement 46 and a second insertion holding arrangement 47 is embodied in an integral manner on these open ends of the hollow chambers 44 and 45 on one side. In the intended manner, these insertion holding arrangements 46 and 47 are embodied so as to receive and insert and consequently also hold the additional holding parts 39 and 41. These insertion holding arrangements 46 and 47 are consequently formed in each case on the ends by the laterally open hollow chambers 44 and 45.

Figure 10:
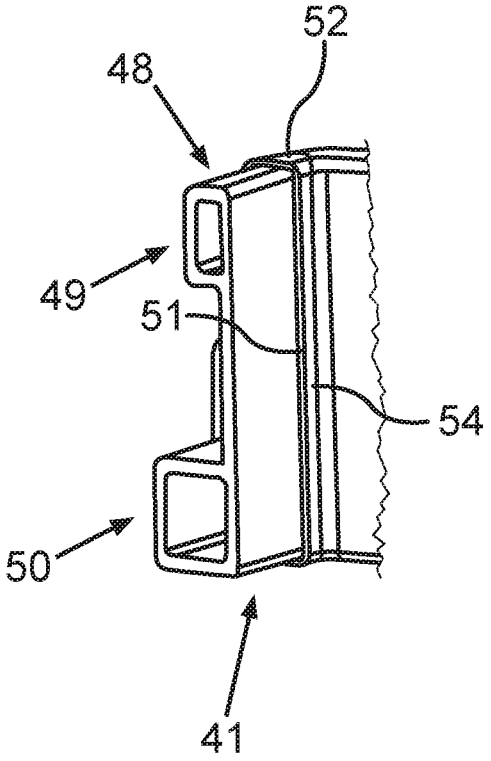
FIG. 10 is a perspective view of an exemplary embodiment of a rear holding part of a side limb of the carrier frame in accordance with FIG. 7.

FIG. 10 illustrates in a perspective view an exemplary embodiment of the holding part 42. A first limb 48 is an insertion part for inserting into an insertion holding arrangement 46, 47 of the profile rail 38. The limb 48 has insertion elements 49 and 50. These are likewise embodied as hollow chambers. The insertion elements 49 and 50 are embodied so as to insert into the hollow chambers 44 and 45 precisely and in particular with a form-locking or force-locking connection or fit. A form-locking connection is a connection that connects two elements together due to the shape of the elements themselves (e.g. ball and socket), as opposed to a force-locking connection, which locks the elements together by force external to the elements (e.g. a screw).

Furthermore, it is also apparent that the limb 48 has a stopping edge 51. The stopping edge 51 is provided so as to directly stop on a boundary edge 53 (FIG. 8, 9) of the profile rail 38 on the open end 6. In particular, a flush arrangement of flat regions of the holding part 41 with respect to flat regions of the profile rail 38 is rendered possible by this embodiment of the limb 48. In particular, in the assembled state, a flush transition is consequently rendered possible between an upper side 52 of the holding part 41 to the upper delimiting wall 44*a* of the upper hollow chamber 44. Furthermore, a flush transition is rendered possible to an inner side 54 of the holding part 41, in particular of the limb 48, to a front side 43*c* (FIG. 8) of the front plate 43. Furthermore, a flush transition between a rear side edge wall of the holding parts 39 and 41 to rear walls or rear delimiting walls 44*c* and 45*c* of the hollow chambers 44 and 45 is also rendered possible by this in particular peripheral stopping edge 51.

The holding parts 39 and 41 are consequently embodied as one piece with the side limbs 17 and 18. The holding parts are embodied as rear ends of the side limbs 17 and 18.

Furthermore, holding elements 55 are also embodied on the holding parts 39 and 41 in FIG. 7 and the holding elements can be provided in an exemplary embodiment. The holding elements 55 are provided so as to hold the carrier frame 16 on the inner container 4.

The following is a summary list of reference numerals and the corresponding structure used in the above description of the invention:

1 Household refrigeration appliance
2 Housing
3 Outer housing
4 Inner container
5 Receiving space
6 Intermediate space
7 Door
8 Storage plate arrangement
9 First storage plate
10 Base plate
11 Rear edge profile
12 Front edge profile
13 Second storage plate
14 Base plate
15 Front edge profile
16 Carrier frame
17 Side limb
18 Side limb
19 Connecting limb
20 Front edge
21 Side edge
22 Side edge
23 Rear edge
24 Free space
25 Side edge
26 Side edge
27 Front edge
28 Rear edge
29 Upper side
30 Upper side
31 Guiding arrangement
32 Front end
33 Inner side
34 Rear end
35 Rear edge profile
36 Side edge profile
37 Side edge profile
38 Profile rail
39 Holding part
40 End
41 Holding part
42 End
43 Front plate
43*a* Boundary edge
43*b* Lower edge
43*c* Front side
44 Hollow chamber
44*a, b, c* Delimiting walls
45 Hollow chamber
45*a, b, c* Delimiting walls
46 Insertion holding arrangement
47 Insertion holding arrangement
48 Limb
49 Insertion element
50 Insertion element
51 Stop edge
52 Upper side
53 Boundary edge
54 Inner side
55 Holding element

The invention claimed is:

1. A storage plate configuration for installation in a household refrigeration appliance, the storage plate configuration comprising:

a first storage plate;

a second storage plate being separate from said first storage plate; and a carrier frame on which said first storage plate and said second storage plate are disposed, wherein said carrier frame having a guiding configuration and at least one of said first and second storage plates being displaceable relative to said carrier frame and to another one of said first and second storage plates by way of said guiding configuration, wherein said carrier frame being embodied as open when viewed in a peripheral direction, said carrier frame having a first side limb and an opposite-lying second side limb being separate from said first side limb and said first and second side limbs being connected to a connecting limb being in turn separate from said first and second side limbs, wherein said connecting limb being a profile rail embodied from metal, said profile rail having a front plate with a first upper hollow chamber being formed on an upper edge of said front plate of said profile rail and a second lower hollow chamber being embodied spaced from said first upper hollow chamber and formed on a lower edge of said front plate of said profile rail, said first and second hollow chambers extending toward a rear starting from said front plate.

2. The storage plate configuration according to claim 1, wherein said profile rail is produced in one piece.

3. The storage plate configuration according to claim 1, wherein said profile rail is a roll formed profile.

4. The storage plate configuration according to claim 1, wherein said profile rail is formed from stainless steel.

5. The storage plate configuration according to claim 1, wherein said profile rail is straight.

6. The storage plate configuration according to claim 1, wherein said hollow chambers are four-sided in cross section and are open in said cross section.

7. The storage plate configuration according to claim 1, wherein when viewed in a depth direction of the storage plate configuration said first upper hollow chamber has a smaller depth than said second lower hollow chamber.

8. A storage plate configuration for installation in a household refrigeration appliance, the storage plate configuration comprising:

a first storage plate;

a second storage plate being separate from said first storage plate;

a carrier frame on which said first storage plate and said second storage plate are disposed, wherein said carrier frame having a guiding configuration and at least one of said first and second storage plates being displaceable relative to said carrier frame and to another one of said first and second storage plates by way of said guiding configuration, wherein said carrier frame being embodied as open when viewed in a peripheral direction, said carrier frame having a first side limb and an opposite-lying second side limb being separate from said first side limb and said first and second side limbs being connected to a connecting limb being in turn separate from said first and second side limbs, wherein said connecting limb being a profile rail embodied from metal, wherein:

said profile rail is embodied as open on a first end and said first end is embodied as a first insertion holding configuration for an additional holding part of the storage plate configuration; and/or said profile rail is embodied as open on a second end, and said second end is embodied as a second insertion holding configuration for a further holding part of the storage plate configuration.

9. The storage plate configuration according to claim 8, wherein said first and second insertion holding configurations are formed on said first and second ends at least by laterally open hollow chambers.

10. The storage plate configuration according to claim 8, further comprising at least one holding part formed in one piece on a rear end of one of said first and second side limbs.

11. The storage plate configuration according to claim 10, wherein said holding part has two insertion elements that are embodied for inserting into said laterally open hollow chambers with a form-locking fit.

12. The storage plate configuration according to claim 10, wherein said holding part has two insertion elements that are embodied for inserting into said laterally open hollow chambers with a force-locking fit.

13. The storage plate configuration according to claim 11, wherein said two insertion elements are embodied as hollow.

14. A household refrigeration appliance, comprising:

a storage plate configuration, containing:

a first storage plate;

a second storage plate being separate from said first storage plate; and a carrier frame on which said first storage plate and said second storage plate are disposed, wherein said carrier frame having a guiding configuration and at least one of said first and second storage plates being displaceable relative to said carrier frame and to another one of said first and second storage plates by way of said guiding configuration, wherein said carrier frame being embodied as open when viewed in a peripheral direction, said carrier frame having a first side limb and an opposite-lying second side limb being separate from said first side limb and said first and second side limbs being connected to a connecting limb being in turn separate from said first and second side limbs, wherein said connecting limb being a profile rail embodied from metal, wherein:

said profile rail is embodied as open on a first end and said first end is embodied as a first insertion holding configuration for an additional holding part of the storage plate configuration; and/or said profile rail is embodied as open on a second end and said second end is embodied as a second insertion holding configuration for a further holding part of the storage plate configuration.

* * * * *